US010069210B2

(12) United States Patent
Cartaillac et al.

(10) Patent No.: US 10,069,210 B2
(45) Date of Patent: Sep. 4, 2018

(54) ORTHOGONAL-MODE JUNCTION COUPLER AND ASSOCIATED POLARIZATION AND FREQUENCY SEPARATOR

(71) Applicant: THALES, Courbevoie (FR)

(72) Inventors: Erwan Cartaillac, Labatut (FR); Pierre Bosshard, Tournefeuille (FR); Nicolas Ferrando, Tournefeuille (FR)

(73) Assignee: THALES, Courbevoie (FR)

( * ) Notice: Subject to any disclaimer, the term of this patent is extended or adjusted under 35 U.S.C. 154(b) by 326 days.

(21) Appl. No.: 14/971,946

(22) Filed: Dec. 16, 2015

(65) Prior Publication Data

US 2016/0181702 A1 Jun. 23, 2016

(30) Foreign Application Priority Data

Dec. 19, 2014 (FR) ..... 14 02932

(51) Int. Cl.

| | |
|---|---|
| ***H01P 5/12*** | (2006.01) |
| ***H01Q 15/24*** | (2006.01) |
| ***H01P 1/161*** | (2006.01) |
| ***H01Q 13/02*** | (2006.01) |
| ***H01Q 5/55*** | (2015.01) |

(52) U.S. Cl.

CPC ..... *H01Q 15/24* (2013.01); *H01P 1/161* (2013.01); *H01Q 5/55* (2015.01); *H01Q 13/0258* (2013.01)

(58) Field of Classification Search

CPC ..... H01Q 15/24; H01Q 5/55; H01Q 13/0258; H01P 1/161

See application file for complete search history.

(56) References Cited

U.S. PATENT DOCUMENTS

| | | | | |
|---|---|---|---|---|
| 6,087,908 | A * | 7/2000 | Haller | H01P 1/161 333/122 |
| 6,323,819 | B1 | 11/2001 | Ergene | |
| 2010/0007432 | A1 * | 1/2010 | Uher | H01P 1/161 333/132 |
| 2010/0149058 | A1 | 6/2010 | Bosshard et al. | |
| 2010/0207702 | A1 | 8/2010 | Perottino et al. | |

* cited by examiner

*Primary Examiner* — Robert J Pascal
*Assistant Examiner* — Kimberly Glenn
(74) *Attorney, Agent, or Firm* — Baker & Hostetler LLP

(57) ABSTRACT

An orthogonal-mode junction coupler and an associated polarization and frequency separator, the junction coupler comprises three opening slots, referred to as coupling slots, which are made in the casing of the coupler and pass through a plane referred to as transverse with respect to the junction coupler. Two of the three coupling slots are aligned along a first axis referred to as transverse with respect to the junction coupler, the section of the two coupling slots being of the same dimensions and of the same orientation. The two coupling slots are configured to be coupled to one of the two orthogonal linear polarizations. The third coupling slot is situated on a second axis referred to as transverse with respect to the junction coupler, the second transverse axis being substantially orthogonal with respect to the first transverse axis.

10 Claims, 3 Drawing Sheets

ORTHOGONAL-MODE JUNCTION COUPLER AND ASSOCIATED POLARIZATION AND FREQUENCY SEPARATOR

CROSS-REFERENCE TO RELATED APPLICATION

This application claims priority to foreign French patent application No. FR 1402932, filed on Dec. 19, 2014, the disclosure of which is incorporated by reference in its entirety.

FIELD OF THE INVENTION

The present invention concerns the field of spatial telecommunications. The present invention more particularly concerns an orthogonal-mode junction coupler and an associated polarization and frequency separator.

The present invention applies to monoband or multiband linearly polarized sources for all types of monobeam and multibeam reflector antennas. By way of example, the invention can be used in the spatial field for antennas aboard a satellite or for antennas in terrestrial stations referred to as ground stations.

In the field of spatial telecommunications, antennas require levels of polarization decoupling below −50 dB for monobeam applications and below −35 dB for multiple beams. To attain these levels of performance, it is necessary to use complex radio-frequency architectures notably on the paths for recombining the vertically and horizontally polarized signals.

BACKGROUND

To attain these performance levels, it is known practice to use, on the sources for the antennas, quad-arm exciters based on an orthogonal-mode junction coupler (also known by the abbreviation OMJ for "OrthoMode Junction") comprising four coupling accesses and systems for recombining the polarizations. The function of the orthogonal-mode junction coupler is to extract or excite the two modes of linear polarization.

However, this device complicates the system for recombining the polarizations notably in respect of the routing of the guides with a set-up on two layers in order to perform this function. This complex recombination system therefore penalizes the size and mass of the sources. Moreover, the use of such an architecture on Gregorian antennas is more difficult to organize owing to the size of the source and the poor fields of view that are generated, affecting the radiation patterns.

As an illustration, FIG. 1 shows an exemplary embodiment of such an architecture in a dual-band configuration. The device comprises an orthogonal-mode junction coupler 10, one end of which is connected to a horn 12 by means of a transformation device. A second end is connected to a polarization separator 14 (also known by the abbreviation OMT for "OrthoMode Transducer") by means of a cut-off filter 13. Each of the four coupling accesses of the coupler 10 is connected to a filtering arm 15. The outputs of these filtering arms 15 are recombined two by two by means of an "H"-divider 17, which is also called a "magic T", with a load 19. The last access of each summer 17 corresponds to an input/output port of the device. Equally, the two accesses of the polarization separator 14 that are not connected to the cut-off filter 13 correspond to two other input/output ports of the device.

FIG. 2 shows a second type of architecture known from the prior art allowing the required performance levels to be obtained. This device comprises a horn 12 connected to a polarization separator 14 so as to separate the two modes of polarization of the signal and each of the two arms of said polarization separator 14 is then connected to a duplexer 16 so as to extract the two frequency bands that are present in the signal.

This second architecture has the advantage of having a smaller number of microwave components in order to perform the function of separating the frequency bands and the polarizations. However, it can be used only when frequency bands are sufficiently close together. Moreover, the use of an asymmetric polarization separator 14 makes separation of the polarizations more sensitive owing to the possible excitation of higher modes.

It is also known practice to use an orthogonal-mode junction coupler 10 having two coupling accesses. FIG. 3 illustrates an exemplary embodiment thereof. In this figure, one end of the orthogonal-mode junction coupler 10 is connected to a horn 12 by means of a polarization transformation device 11 and a second end is connected to a polarization separator 14 by means of a cut-off filter 13. Each coupling access of the coupler 10 is connected to a filtering arm 15. The two outputs of the polarization separator and the outputs of the filtering arms 15 define input/output ports of the device.

This architecture has the advantage of being simple and space-saving but affords a relatively low level of decoupling between the modes of polarization. This configuration affords a level of horizontal/vertical polarization decoupling of only approximately −18~−22 dB, whereas the needs are −50 dB for assignments with fully developed monobeam coverage and −35 dB for multiple beams. This poor decoupling can be explained by the imbalance in the electrical field linked to the use of a single polarization coupling slot on the orthogonal-mode junction coupler.

SUMMARY OF THE INVENTION

It is an aim of the invention notably to correct all or some of the aforementioned disadvantages by proposing a solution allowing both the size and the mass of linearly polarized sources to be reduced while guaranteeing a level of performance at least equivalent to the current linearly polarized sources.

To this end, the subject of the invention is an orthogonal-mode junction coupler having a casing delimiting a coupling cavity, electromagnetic signals polarized according to at least two orthogonal linear polarization modes being able to propagate inside the coupling cavity, said coupler comprising two accesses, called input/output accesses, passing through said casing and opening into said coupling cavity, said two input/output accesses being aligned along an axis referred to as longitudinal with respect to the junction coupler and being arranged at opposite ends of the junction coupler, said longitudinal axis being defined by the direction of propagation of the electromagnetic signals, three opening slots, referred to as coupling slots, are made in the casing of the junction coupler, said three coupling slots passing through a plane referred to as transverse with respect to the junction coupler, said transverse plane being substantially perpendicular to the longitudinal axis, two of said three coupling slots being aligned along a first axis referred to as transverse with respect to the junction coupler, the section of said two coupling slots being of the same dimensions and of the same orientation, the two coupling slots being configured to be coupled to one of the two orthogonal linear polarizations of the electromagnetic signals propagating between the two input/output accesses, the third coupling slot being situated on a second axis referred to as transverse with respect to the junction coupler, said second transverse axis being substantially orthogonal with respect to the first transverse axis.

According to one embodiment, a slot, referred to as image slot, is made in the casing of the coupler, said image slot passing through the transverse plane and being opposite the third coupling slot, the section of said image slot being of the same dimensions and of the same orientation as the section of the third coupling slot, one end of said image slot opening into the coupling cavity and the other end being closed by a short-circuit plane.

According to one embodiment, the two coupling slots aligned along the transverse axis are configured to be coupled to the vertical linear polarization, the third coupling slot being configured to be coupled to the horizontal polarization.

According to one embodiment, the two coupling slots aligned along the transverse axis are configured to be coupled to the horizontal linear polarization, the third coupling slot being configured to be coupled to the vertical polarization.

According to one embodiment, the cross-section of the coupling cavity is taken from a substantially square, rectangular, circular or elliptical shape.

According to one embodiment, the coupling slots are oriented so as to allow electrical coupling.

According to one embodiment, the coupling slots are oriented so as to allow magnetic coupling.

According to one embodiment, an input/output access is connected to a short-circuit plane or a cut-off filter.

The subject of the invention is also a polarization and frequency separator comprising an orthogonal-mode junction coupler according to one of the preceding embodiments, said coupler comprising two input/output accesses and three coupling slots, one input/output access being connected to an antenna and the other access being connected to a short-circuit plane, a coupler slot forming a polarization access and the other two coupling slots being joined together by means of a summer in order to form another polarization access.

According to one embodiment, a filter arm is connected to each coupling slot and the short-circuit plane connected to an input/output access is replaced by a cut-off filter.

According to one embodiment, the filtering arms and the summer are produced using a technology taken from waveguide technology, coaxial technology or microstrip technology.

BRIEF DESCRIPTION OF THE DRAWINGS

Other special features and advantages of the present invention will become more clearly apparent upon reading the description below, which is provided by way of illustration, without implying limitation and with reference to the appended drawings, in which.

DETAILED DESCRIPTION

Figure 1:
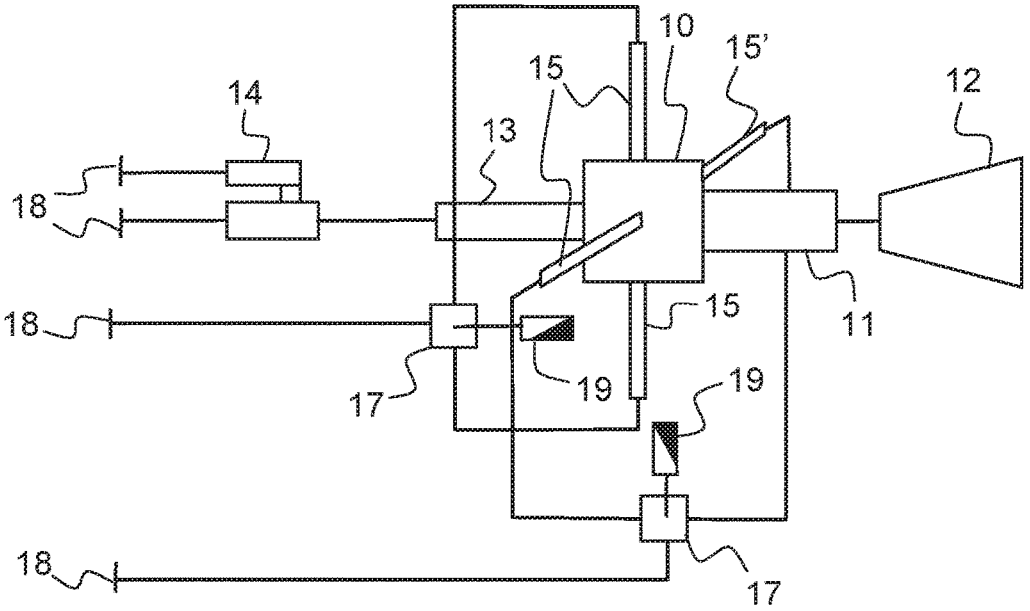
FIGS. 1 to 3 show exemplary embodiments of polarization and frequency separators known from the prior art.
Figure 2:
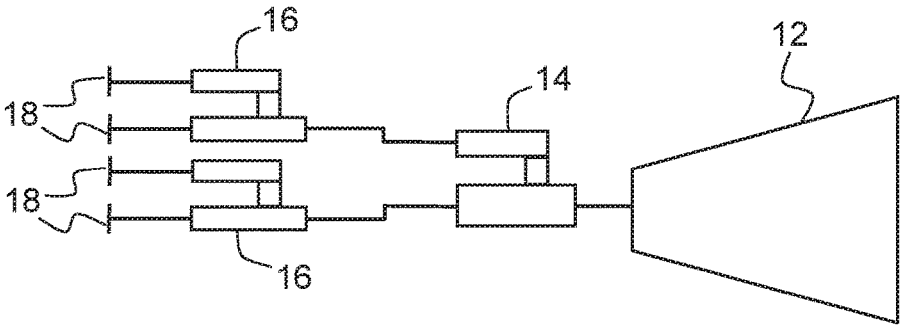
Figure 3:
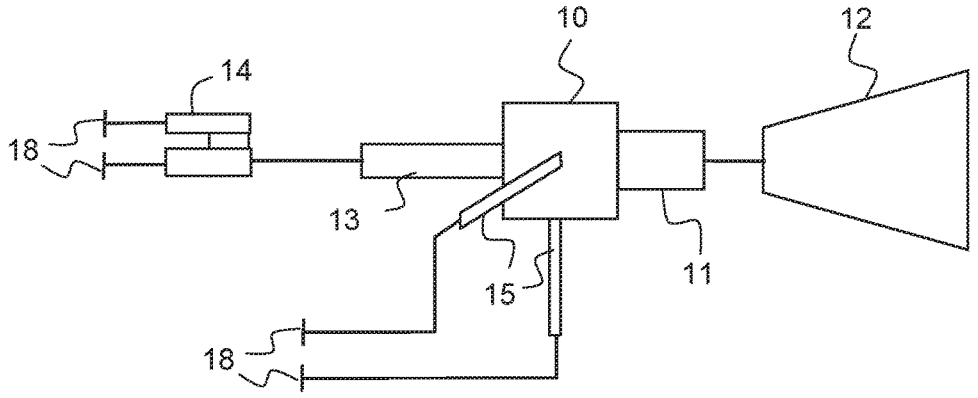
Figure 4:
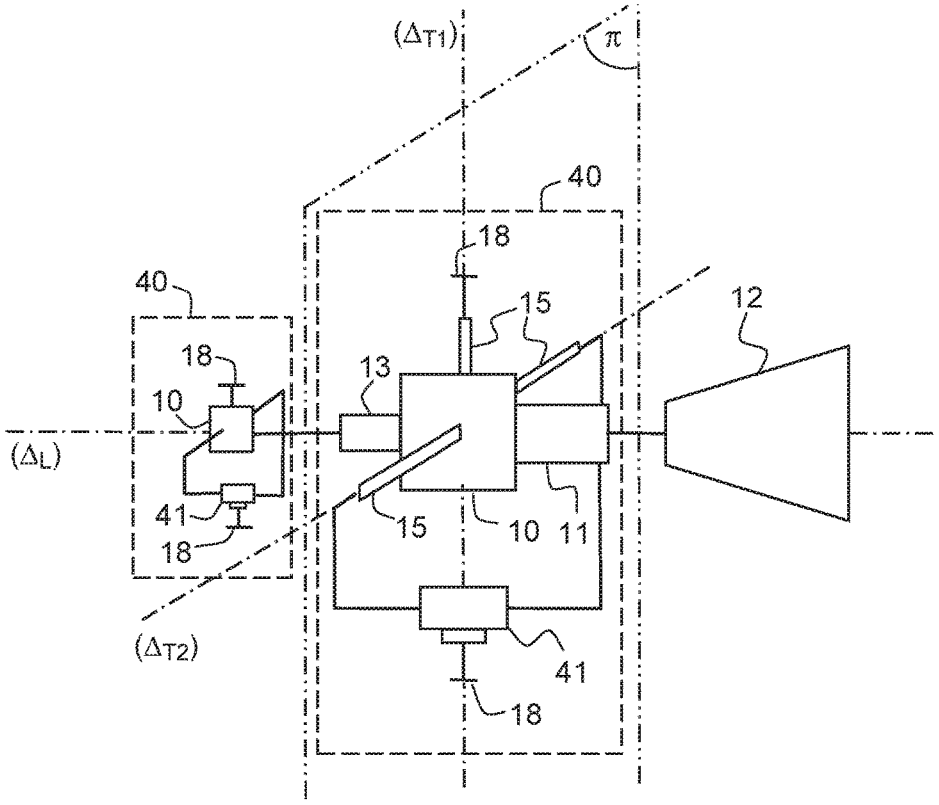
FIG. 4 shows an example of a transmission/reception source comprising at least one embodiment of a polarization and frequency separator according to the invention.

FIG. 4 shows an exemplary embodiment of a transmission/reception source. This source can be placed in front of the reflector of an antenna. The example of a presented source is configured to operate on two frequency bands, a transmission frequency band and a second, reception band. To this end, the source comprises two polarization and frequency separators 40, each polarization and frequency separator being configured to operate on different frequency bands. This example in no way implies limitation and the source can be monoband or multiband with a number of frequency bands greater than two.

The polarization and frequency separators 40 are configured to separate or couple the orthogonally (vertically and horizontally) polarized signals propagating inside them. It is recalled that, by convention, when considering a direct orthogonal base ($\vec{e}_x$, $\vec{e}_y$, $\vec{e}_z$) and when the electromagnetic signal is considered to propagate in the direction of the vector $\vec{e}_z$, the term used is vertical polarization, or V, if the electric field of said electromagnetic signal is oriented in the direction of the vector $\vec{e}_x$ and horizontal polarization if it is oriented in the direction of the vector $\vec{e}_y$.

If the horn 12 operates under different polarization from that of the polarization and frequency separator 40, the source can comprise a polarization transformation device 11 between the polarization and frequency separator 40 and the antenna 12. By way of example, in the example illustrated in FIG. 4, the horn antenna 12 operates under circular polarization and the transformation device 11 is configured to transform linear (horizontal or vertical) waves from the polarization and frequency separator 40 into circularly polarized waves, and vice versa.

Figure 5:
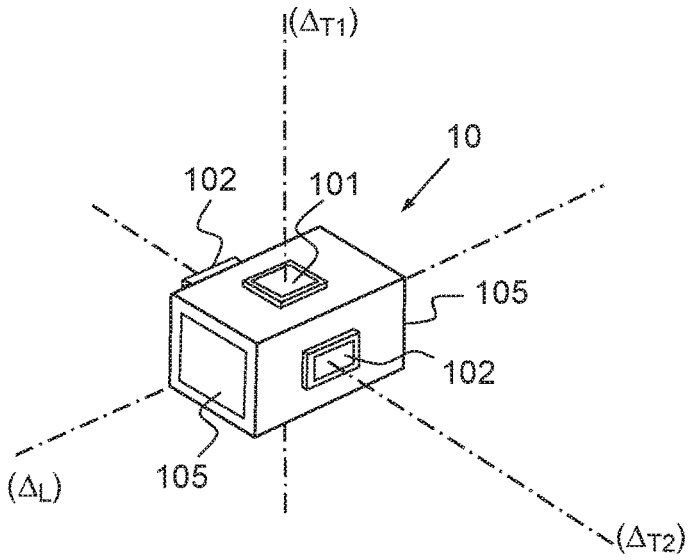
FIG. 5 shows an exemplary embodiment of an orthogonal-mode junction coupler according to the invention.

The polarization and frequency separator 40 comprises an orthogonal-mode junction coupler 10. Such a coupler 10 is also known by the term "OrthoMode Junction" or OMJ. By way of example, FIG. 5 illustrates an embodiment of such a coupler 10. This device is intended to extract or excite the two modes of polarization of the electromagnetic signals propagating inside said coupler 10.

The junction coupler 10 comprises a casing allowing delimitation of an interior volume forming a coupling cavity. The cross-section of this coupling cavity may be of substantially square, substantially rectangular, substantially circular or substantially elliptical shape, for example. The coupling cavity is configured to allow the propagation of electromagnetic signals polarized according to at least two modes of orthogonal linear polarization, vertical and horizontal.

The orthogonal-mode junction coupler 10 comprises two accesses referred to as input/output accesses 105. These accesses 105 pass through said casing and open into the coupling cavity. Electromagnetic signals polarized according to two modes of orthogonal linear polarization are able to propagate between these two input/output accesses 105. These input/output accesses 105 are substantially aligned along an axis $\Delta_L$ referred to as longitudinal with respect to the junction coupler 10 and are arranged at opposite ends of said junction coupler 10. The longitudinal axis ($\Delta_L$) is defined by the direction of propagation of the electromagnetic signals between the input/output accesses 105.

Three opening slots, referred to as coupling slots 101, 102, are made in the casing of the junction coupler 10. These three coupling slots 101, 102 pass through a plane $\pi$ referred to as transverse with respect to the junction coupler 10. This transverse plane $\pi$ is substantially perpendicular to the longitudinal axis $\Delta_L$. The three slots 101, 102 each open into the coupling cavity. These coupling slots 101, 102 are oriented so as to allow electrical coupling or magnetic coupling. These three coupling slots 101, 102 form three coupling accesses for the orthogonal-mode junction coupler 10. By way of example, slots oriented in a longitudinal direction of the coupling cavity allow magnetic coupling. Electrical coupling will be obtained by means of a 90° rotation of the slot.

Two of said three coupling slots are aligned along a first axis $\Delta_{T2}$ referred to as transverse with respect to the junction coupler 10. The two coupling slots 102 are substantially identical. The dimensions of their section and the orientation of the slots are substantially identical. These two coupling slots 102 are both configured to be coupled to one of the two orthogonal linear polarizations of the electromagnetic signals propagating between the two input/output accesses 105, either both according to the vertical polarization or both according to the horizontal polarization.

The third coupling slot 101 is situated on a second axis $\Delta_{T1}$, referred to as transverse with respect to the junction coupler 10. This second transverse axis $\Delta_{T1}$ is in a direction that is substantially orthogonal with respect to the first transverse axis $\Delta_{T2}$. This single coupling slot 101 is configured to be coupled to the different polarization from that being coupled to the two opposite coupling slots 102.

The coupling (or separation) of the electromagnetic signal according to one polarization with two coupling slots that are substantially identical and according to the other polarization with a single coupling slot makes it possible to improve decoupling between the two polarizations. The coupling (or separation) of a particular polarization using two slots makes it possible to refine the field lines of this signal and to favour this polarization compared with the other.

According to one particular embodiment, an additional opening slot, referred to as image slot, is made in the casing of the orthogonal-mode junction coupler. This slot is placed opposite the third coupling slot 101. It passes through the transverse plane $\pi$ and is aligned with the third coupling slot along the transverse axis $\Delta_{T1}$. The section of this image slot has dimensions and an orientation that are substantially identical to those of the third coupling slot 101. One end of this image slot opens into the coupling cavity and the other end is closed by a short-circuit plane. This image slot does not form a coupling access but serves to refine the current lines. Advantageously, it avoids rendering the current lines asymmetric and therefore makes it possible to avoid the generation of higher modes.

Figure 6:
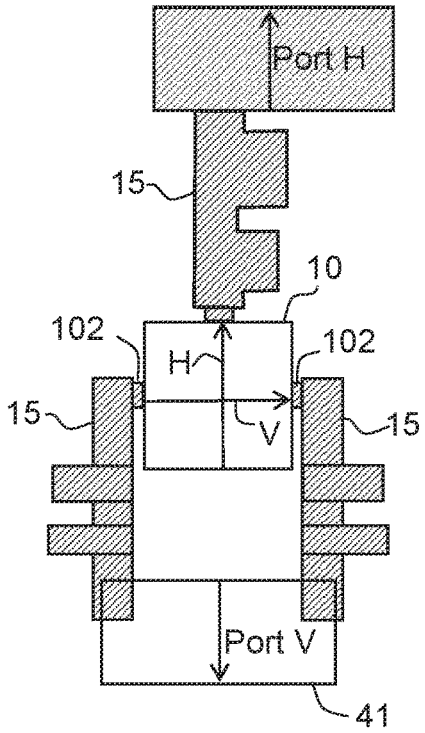
FIG. 6 shows a cross-section of an exemplary embodiment of a polarization and frequency separator according to the invention.

FIG. 6 shows a cross-sectional plane of an exemplary embodiment of the polarization and frequency separator 40 according to a transverse plane passing through the three coupling slots 101, 102.

Each of the two opposite coupling slots 102 is extended by a filtering arm 15. These two arms are then joined together by means of a summer 41 that is also called a "magic T" or divider. The access of the summer 41 that is not connected to the filtering arm 15 forms an access 18 for the polarization transmitted through the arms 15.

One filtering arm 15 is also connected to the third coupling slot 101. The other end of the filtering arm 15 forms an access 18 of the transmitted polarization.

The recombination system, namely the stubs of the filtering arms 15 and the summer 41, can be produced using waveguide technology, using coaxial technology or using microstrip (or barline) technology.

The example illustrated in FIG. 6 corresponds to a multiband use. In the case of monoband use, the coupling slots 101, 102 may comprise no filtering arms 15. The same goes for a polarization and frequency separator 40 situated at the end of a cascaded duplexer chain 40 in a multiband use as illustrated in FIG. 4.

In a use for a multiband frequency source, various polarization and frequency separators 40 can be connected in cascaded fashion. Each polarization and frequency separator 40 is separated by a cut-off filter 13 so as to filter the frequency of the electromagnetic signals. The last polarization duplexer 40 in the chain is terminated by a short-circuit plane. By way of example, FIG. 4 illustrates a dual-band use. A first coupler 10, which is connected to the horn antenna 12, separates (or couples) the horizontal and vertical polarizations of the high frequency band. The cut-off filter 13 between the two couplers 10 attenuates the low frequencies (high-pass filter) and only the high frequencies propagate in the second coupler 10 of smaller dimensions. This second coupler 10 will separate (or couple) the polarizations of the high frequency band. The cut-off filter 13 is connected to one of the two input/output accesses 105 of the coupler 10 and a short-circuit plane is connected to the second input/output access.

Advantageously, the orthogonal-mode junction coupler 10 having three coupling slots 101, 102 according to the invention makes it possible to simplify the recombination system of the polarization and frequency separator 40.

The invention claimed is:

1. An orthogonal-mode junction coupler having a casing delimiting a coupling cavity, electromagnetic signals polarized according to at least two orthogonal linear polarizations being able to propagate inside the coupling cavity, said coupler comprising:

two input/output accesses, passing through said casing and opening into said coupling cavity, said two input/output accesses being aligned along a longitudinal axis that is longitudinal with respect to the junction coupler and being arranged at opposite ends of the junction coupler, said longitudinal axis being defined by the direction of propagation of the electromagnetic signals;

three coupling slots provided in the casing of the junction coupler, said three coupling slots passing through a transverse plane that is transverse with respect to the junction coupler, said transverse plane being substantially perpendicular to the longitudinal axis; and an image slot that is provided in the casing of the coupler, said image slot passing through the transverse plane, one end of said image slot opening into the coupling cavity and another other end of said image slot being closed by a short-circuit plane, wherein a first and a second of said three coupling slots are aligned along a first transverse axis that is transverse with respect to the junction coupler, respective sections of said first and second coupling slots being of the same dimensions and of the same orientation, the first and second coupling slots being configured to be coupled to one of the two orthogonal linear polarizations of the electromagnetic signals propagating between the two input/output accesses, a third of said three coupling slots being situated on a second transverse axis that is transverse with respect to the junction coupler, said second transverse axis being substantially orthogonal with respect to the first transverse axis, said image slot being opposite the third coupling slot, and a section of said image slot being of the same dimensions and of the same orientation as a section of the third coupling slot.

2. The junction coupler according to claim 1, wherein the first and second coupling slots aligned along the transverse axis are configured to be coupled to a vertical linear polarization of the at least two linear orthogonal polarizations, the third coupling slot being configured to be coupled to a horizontal linear polarization of the at least two linear orthogonal polarizations.

3. The junction coupler according to claim 1, wherein the first and second coupling slots aligned along the transverse axis are configured to be coupled to a horizontal linear polarization of the at least two linear orthogonal polarizations, the third coupling slot being configured to be coupled to a vertical linear polarization of the at least two linear orthogonal polarizations.

4. The junction coupler according to claim 1, wherein a cross-section of the coupling cavity is taken from a substantially square, rectangular, circular or elliptical shape.

5. The junction coupler according to claim 1, wherein the three coupling slots are oriented so as to allow electrical coupling.

6. The junction coupler according to claim 1, wherein the three coupling slots are oriented so as to allow magnetic coupling.

7. The junction coupler according to claim 1, wherein one of the two input/output accesses is connected to a short-circuit plane or a cut-off filter.

8. A polarization and frequency separator, comprising an orthogonal-mode junction coupler according to claim 1, wherein one input/output access of the two input/output accesses of the coupler being connected to an antenna and the other input/output access of the two input/output accesses of the coupler being connected to a short-circuit plane, the third coupling slot forming a polarization access, and the first and second coupling slots being joined together by means of a summer in order to form another polarization access.

9. The polarization and frequency separator according to claim 8, wherein a filter arm is connected to each of the three coupling slots and wherein the short-circuit plane connected to the other input/output access is replaced by a cut-off filter.

10. The polarization and frequency separator according to claim 9, wherein the filtering arms and the summer are produced using a technology taken from waveguide technology, coaxial technology or microstrip technology.

* * * * *